US009528529B1

(12) United States Patent
Kraft

(10) Patent No.: US 9,528,529 B1
(45) Date of Patent: Dec. 27, 2016

(54) EXISTING AIR CIRCULATING FANS BY UTILIZING MULTI-DIRECTIONAL BLADE ANGLES

(71) Applicant: Joseph Kraft, College Station, TX (US)

(72) Inventor: Joseph Kraft, College Station, TX (US)

( * ) Notice: Subject to any disclaimer, the term of this patent is extended or adjusted under 35 U.S.C. 154(b) by 0 days.

(21) Appl. No.: 14/992,088

(22) Filed: Jan. 11, 2016

(51) Int. Cl.
*F04D 25/08* (2006.01)
*F04D 29/38* (2006.01)
*F04D 25/06* (2006.01)
*F04D 29/34* (2006.01)

(52) U.S. Cl.
CPC ..... *F04D 29/384* (2013.01); *F04D 25/0693* (2013.01); *F04D 25/088* (2013.01); *F04D 29/34* (2013.01)

(58) Field of Classification Search
CPC .... F04D 25/088; F04D 27/002; F04D 29/325; F04D 29/663; F04D 29/681
See application file for complete search history.

(56) References Cited

U.S. PATENT DOCUMENTS 571,500 A * 11/1896 West ..... B64C 11/065 34/218
871,729 A * 11/1907 McChord ..... B64C 11/065 416/207
4,640,668 A * 2/1987 Yang ..... F04D 25/088 310/68 E
4,693,673 A * 9/1987 Nee ..... F04D 29/38 416/175
4,730,981 A * 3/1988 Kawai ..... F04D 25/10 416/170 R
D330,077 S * 10/1992 Davis ..... D23/413
5,256,037 A * 10/1993 Chatelain ..... F04D 29/662 310/51
D587,799 S * 3/2009 Oleson ..... D23/411
2008/0213097 A1* 9/2008 Oleson ..... F04D 25/088 416/210 R
2009/0162197 A1* 6/2009 Klemo ..... F04D 25/088 416/1

* cited by examiner

*Primary Examiner* — Igor Kershteyn
(74) *Attorney, Agent, or Firm* — Furr Law Firm; Jeffrey Furr, Esq.

(57) ABSTRACT

An improvement on the currently available air circulation fans by altering the shape of the fan blade to increase airflow distribution. Ceiling fans and other air circulating fans typically only force airflow in an axial direction. This device is designed to expand the area of distribution of desired air circulation by the alteration of a distal portion of a fan blade being placed on an angle relative to a proximal portion. This improved fan blade comprises a proximal fastening portion, a middle axially-directed air flow portion and a distal angularly-directed airflow portion. The addition of the angled portion of the fan blade is designed to significantly improve airflow distribution and thereby increase the efficiency and effectiveness of the complete fan unit without requiring any other significant modifications of the fan motor or other mechanics.

4 Claims, 4 Drawing Sheets

EXISTING AIR CIRCULATING FANS BY UTILIZING MULTI-DIRECTIONAL BLADE ANGLES

FIELD OF INVENTION

This device refers to the field of air flow circulation and more specifically to electric fans and even more specifically to the shape of the fan blade itself.

BACKGROUND OF THE INVENTION

Traditional ceiling fans and other air circulating fans that are currently available have significant limitations with airflow being generally limited to the axial flow direction and confined to an air column that is only slightly larger than the diameter of the fan itself. This has led to multiple innovations over the years to tilt, rotate or oscillate the fan body itself in order to distribute the airflow more equitably around a given area. This current device is designed to provide improved airflow distribution utilizing the model of the current single axis fans such as, but not limited to, ceiling fans. The focus of this innovation is in the unique shape of the fan blade itself. Traditionally fans have blades that are designed for directional air flow. The blades of a traditional fan are mounted radially around a center axis and rotate around this axis forcing air in the direction of the axis itself. The radially mounted blade is pitched slightly in order to force air in an axial direction when rotated around this same axis. The pitch of the blade can create airflow in either axial direction depending on the direction of rotation. Historically, simple construction and manufacturing combined with generally adequate airflow have made the currently utilized pitched flat blade design the standard blade design for more than a century. Unfortunately, this blade design is somewhat limited to a very defined columnar shaped area of desired airflow. This proposed improvement in blade shape will allow for multi-directional airflow and much greater overall effectiveness of the fan without having to change other manufactured components.

Other fan blade systems have been proposed over the years and therefore to provide clear differentiation from each of these systems the disclosures of the associated US patents are included for reference herein. Oleson et al. describes an attachable airfoil winglet in U.S. Pat. No. 8,162,613, "ANGLED AIRFOIL EXTENSION FOR A FAN BLADE", which is clearly designed as a separate attachment with a concave lower and a convex upper surface. Cooke, U.S. Pat. No. 4,662,823, "AIR TURBULENCE BLADES FOR CEILING FANS" and McChord, U.S. Pat. No. 871,729, "ELECTRIC FAN", likewise describe blade tip attachments of different shapes in order to attempt better airflow, however both are still design limited to mechanically connected attachments with the associated problems in execution and esthetics. Another attachment based blade design by Aynsley, U.S. Pat. No. 7,252,478, "FAN BLADE MODIFICATIONS", is an attached winglet designed to "improve aerodynamics of the fan blades" and does not affect radial airflow distribution. Bird, U.S. Pat. No. 6,719,533, "HIGH EFFICIENCY CEILING FAN", describes blades that have concave top and bottom surfaces and are tapered, twisted, and have a gentle curve with a "continuously graduated dihedral". This design is limited in that it only minimally affects the radial distribution of airflow.

While a variety of components and features have been incorporated into fans and fan systems, it is believed that no other fan blades described in prior art have made or used the invention described in the appended claims.

SUMMARY OF THE INVENTION

Currently available fans, more particularly ceiling fans, are designed to have radially distributed fan blades that are positioned horizontally radiating from a vertically mounted axis and create significant air flow in a space that is directly above or below the fan. These fans utilize standard flat blades that attach to a rotating hub at the axis. The blades are connected to the hub on the proximal end and this hub is rotated by an electric motor. Each blade is pitched in such a way as to force air downward (or upward if in reverse) when it is rotated around the axis by the force of the motor. This design creates a sort of wind column above or below the fan thus limiting the desired air circulation to almost exclusively the area directly under the fan leaving the rest of the room with minimal appreciable air circulation.

This proposed new blade shape is designed to not only force air downward as the other fans do, but also to force air movement more radially from the fan which will produce a much more widespread airflow pattern from the same fan. This newly designed fan blade is very similar to the traditional fan blades at the proximal most part of the blade where it configured to connect to the hub of the fan. The main difference is that the distal portion of the blade is angled upward in such a way as to allow the pitch of the blade to force air more radially outward in addition to the downward flow from the middle portion of the fan blade. The angled portion of the blade can have multiple embodiments depending on the amount of dihedral angle of the blade off of the horizontal plane, the angle of the of the distal portion with respect to the longitudinal axis of the proximal portion of the blade, the blade pitch, as well as the curvature of this same portion.

BRIEF DESCRIPTION OF DRAWINGS

The following drawings serve to illustrate several aspects of the proposed invention, and together with the description serve to explain the principles of the invention; it being understood, however, that this invention is not limited to the precise depictions as illustrated. In the drawings, like reference numerals refer to like elements throughout all figures.

DETAILED DESCRIPTION OF PREFERRED EMBODIMENTS

The following description of certain embodiments of the invention should not be used to limit the scope of the invention. It is possible that other features, aspects, versions, and advantages of the invention may become apparent to those skilled in the art based on the following description. Accordingly, the descriptions and drawings should serve as illustrative in nature and not at all restrictive.

Figure 1:
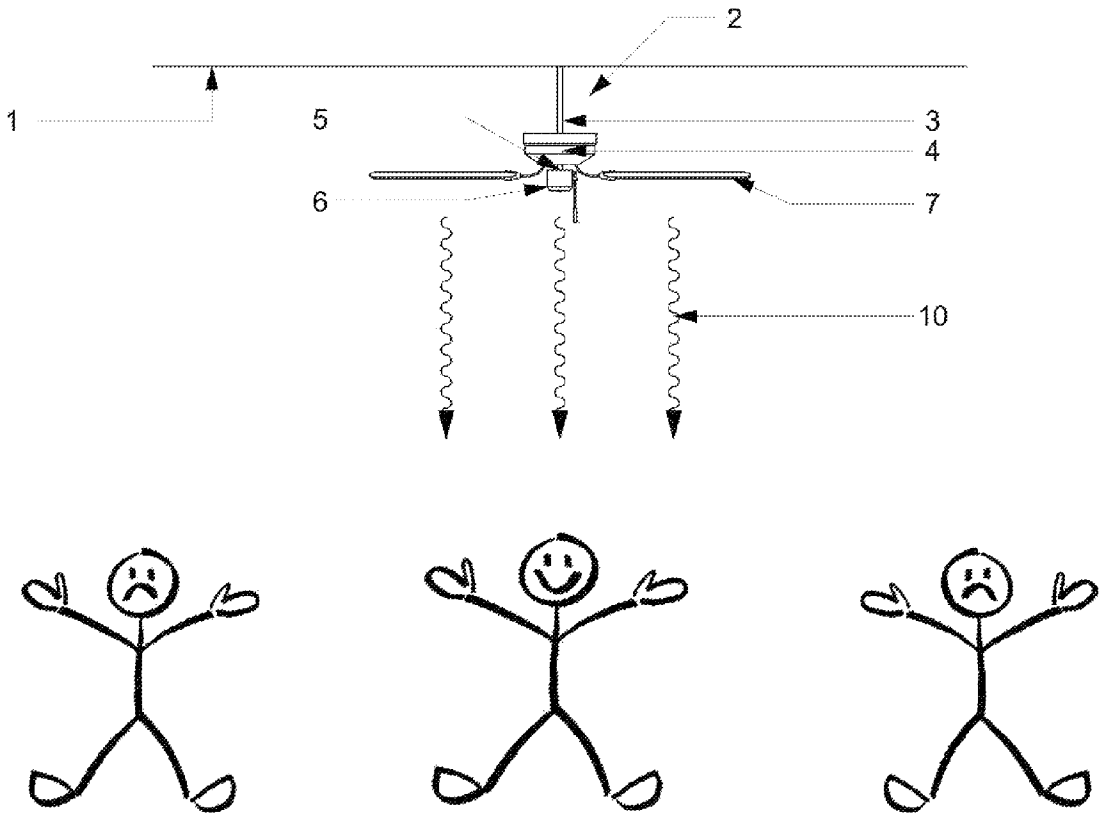
FIG. 1 is a depiction of an airflow diagram of a ceiling fan utilizing a exemplary straight fan blade.

FIG. 1 illustrates a standard ceiling fan typically mounted to a ceiling 1. A connection to the ceiling is accomplished by a mounting bracket 2. Extending downward from the mounting bracket is a downrod 3 that extends down and connects to a motor housing 4 that contains an electric motor. The downrod also serves as a conduit for electrical supply wires to connect the fan motor to a municipal power supply. The motor housing has a motor-driven shaft 5 attached to a hub 6 that protrudes downward from the housing and is free to rotate independent of the housing which is designed to remain stationary. This hub is purposed to be a mounting point for a fan blade 7 which is mounted in a horizontal fashion and in a manner that radiates outward from the hub. The blades are mounted to the hub in a manner that gives each blade an angle of pitch in which a leading edge 8 of the blade is higher in elevation than a trailing edge 9 when rotating in such a direction so as to create downward radial airflow. The exact number of blades that are mounted to the hub is dependent on individual fan designs. Airflow in this illustration is depicted by directional arrows 10 which demonstrate the area of most of the appreciable air circulation with a conventional ceiling fan.

Figure 2:
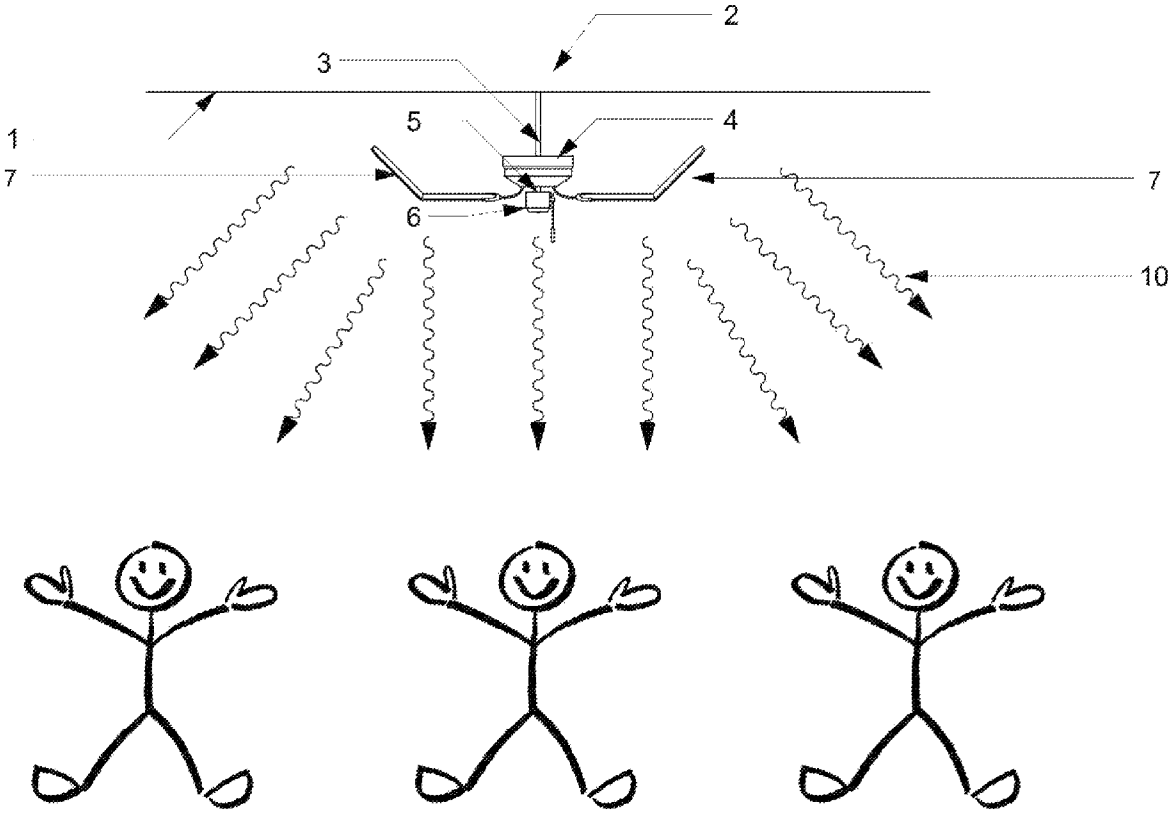
FIG. 2 is a depiction of an airflow diagram of a ceiling fan utilizing the proposed fan blade with multi-directional blade angles.

FIG. 2 illustrates the same ceiling fan as described in FIG. 1 with the only difference being that this fan has fan blades that have an upturned distal portion of the blade 7. Also note that the upturned distal portion is angularly pitched with the leading edge being slightly more proximal than the trailing edge in order to force airflow in an outward, radial direction. The airflow diagram depicted by the directional arrows 10 illustrates how this change in blade shape can produce significantly more radial airflow in addition to the usual axial airflow of a conventional ceiling fan in order to expand the area of air circulation benefits.

Figure 3:
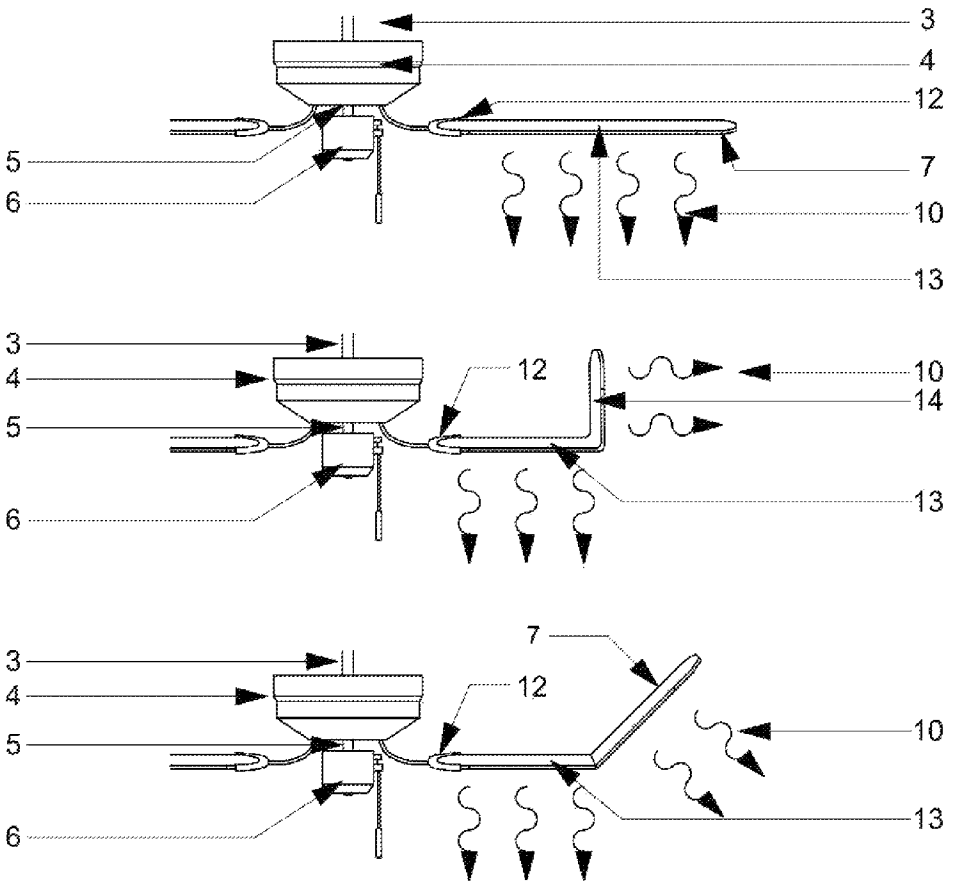
FIG. 3 is a front perspective view of a ceiling fan demonstrating a typically mounted single fan blade on a conventional ceiling fan (A) as well as two possible embodiments of the proposed improved fan blades (B and C).

FIG. 3 depicts an illustration of a front perspective view of 3 different ceiling fans. The fan labeled "A" demonstrates a mounted single fan blade 7 on a conventional ceiling fan. The fan labeled "B" demonstrates one embodiment of the proposed improved fan blade in which the distal portion of the blade is turned upright at a 90 degree angle with respect to a middle portion of the blade. The fan labeled "C" demonstrates another embodiment of the proposed improved fan blade in which the distal portion of the blade is upturned at an angle of approximately 45 degrees with respect to the middle portion of the blade. Each of these depictions of a single mounted fan blade 7 demonstrates an attachment portion 12 of the blade at a proximal end, the middle portion 13 of the blade 7 that runs horizontal at approximately a right angle to the axis of the motor and then the upward angled distal portion 14 of the blade.

Figure 4:
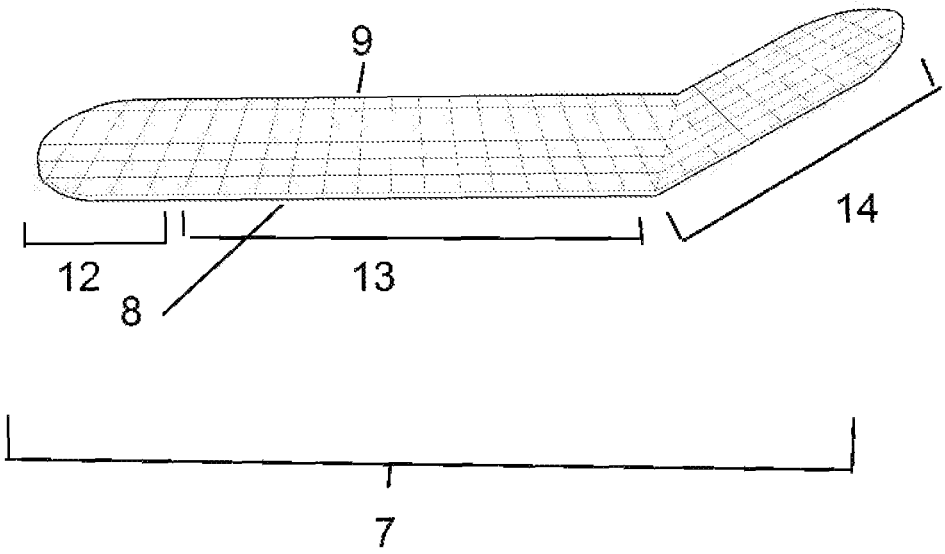
FIG. 4 is a side perspective view of a proposed individual fan blade of one embodiment

FIG. 4 depicts a side perspective view of one embodiment of the proposed individual fan blade 7 demonstrating the upward-angled distal portion 14. This view also demonstrates the pitch applied to the distal portion 14 of the blade 7 with the leading edge 8 being positioned slightly more superior and proximal with respect to the trailing edge 9 thus rendering the distal angled portion of the blade 14 to be in such a position so as to generate a more radially directed airflow when rotating in such a direction so as to produce downward axial airflow by the middle portion of the blade.

What is claimed is:

1. A fan for an air circulating fan comprising: a plurality of fan blades that have a proximal attachment end, a relatively flat middle portion extending at approximately a right angle to the axis and an upwardly angulated distal portion, the blade comprising:

(a) a proximal attachment portion to attach the blade to a hub/axis with each blade attached with an angle of pitch, (b) a mid portion that is approximately at a right angle to the hub/axis and extends in a radial fashion from the hub/axis, and (c) an upwardly angled distal blade portion, wherein the hub is attached to a shaft, the shaft is connected to a motor which drives the shaft in a circular motion where the motor is in a motor housing which is connected to a downrod where the downrod services as a conduit for electric supply wires that connect to the motor, where the downrod connects and extends downward from a mounting bracket.

2. A fan for air circulating fan according to claim 1 wherein the mounting bracket is attached to a ceiling.

3. A method for air circulation comprising:

using a fan with a plurality of fan blades, moving said fan blades in a circular motion, having said fan blades have a proximal attachment end, a relatively flat middle portion extending at approximately a right angle to the axis and an upwardly angulated distal portion, having the blade comprising:

(a) a proximal attachment portion to attach the blade to a hub/axis with each blade attached with an angle of pitch, (b) a mid portion that is approximately at a right angle to the hub/axis and extends in a radial fashion from the hub/axis, and (c) an upwardly angled distal blade portion;

having the hub is attached to a shaft, having the shaft is connected to a motor driving the shaft in a circular motion where the motor is in a motor housing which is connected to a downrod where the downrod services as a conduit for electric supply wires that connect to the motor, and having the downrod connects and extends downward from a mounting bracket.

4. A method for air circulation according to claim 3 wherein the mounting bracket is attached to a ceiling.

* * * * *